US007528547B2

(12) United States Patent
Kim

(10) Patent No.: US 7,528,547 B2
(45) Date of Patent: May 5, 2009

(54) PLASMA DISPLAY PANEL WITH MAGNESIUM OXIDE PROTECTION LAYER INCLUDING DOPANTS

(75) Inventor: Ki-Dong Kim, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 570 days.

(21) Appl. No.: 11/133,695

(22) Filed: May 19, 2005

(65) Prior Publication Data

US 2005/0264211 A1 Dec. 1, 2005

(30) Foreign Application Priority Data

May 25, 2004 (KR) ..... 10-2004-0037268

(51) Int. Cl.
*H01J 17/49* (2006.01)

(52) U.S. Cl. ..... 313/587; 313/582

(58) Field of Classification Search ..... 313/582–587
See application file for complete search history.

(56) References Cited

U.S. PATENT DOCUMENTS

| | | | | |
|---|---|---|---|---|
| 6,879,107 | B2 * | 4/2005 | Hirano et al. | 313/587 |
| 7,253,561 | B2 * | 8/2007 | Kim et al. | 313/587 |
| 2004/0070374 | A1 | 4/2004 | Park | |

FOREIGN PATENT DOCUMENTS

| | | | |
|---|---|---|---|
| CN | 1497642 | A | 5/2004 |
| EP | 1482068 | A1 * | 12/2004 |
| JP | 10-334809 | | 12/1998 |
| JP | 2000-063171 | | 2/2000 |
| JP | 2001-035382 | | 2/2001 |
| JP | 2003-031136 | | 1/2003 |
| JP | 2003-109511 | | 4/2003 |
| JP | 2004-134407 | | 4/2004 |

(Continued)

OTHER PUBLICATIONS

Korean Patent Abstract, Publication No. 1019980079548 A, Published Nov. 25, 1998, in the name of Takenouchi Takeyoshi, et al.

(Continued)

*Primary Examiner*—Nimeshkumar D Patel
*Assistant Examiner*—Anne M Hines
(74) *Attorney, Agent, or Firm*—Christie, Parker & Hale, LLP

(57) ABSTRACT

A plasma display panel comprising first and second substrates positioned substantially parallel to each other, facing each other and separated from each other by a predetermined distance is disclosed. A plurality of address electrodes are formed on the first substrate. A first dielectric layer covers the plurality of address electrodes on the first substrate. A plurality of barrier ribs having predetermined heights are mounted on the first dielectric layer, creating discharge spaces between the first and second substrates. Phosphor layers are formed within the discharge spaces. A plurality of discharge sustain electrodes are formed on the surface of the second substrate facing the first substrate and are positioned perpendicular to the address electrodes on the first substrate. A second dielectric layer is formed on the second substrate covering the discharge sustain electrodes. A protection layer comprising MgO and Ca, Al, Fe and Si dopants covers the second dielectric layer.

10 Claims, 5 Drawing Sheets

FOREIGN PATENT DOCUMENTS

KR 1998-079548 11/1998

OTHER PUBLICATIONS

Patent Abstracts of Japan, Publication No. 2003-031136, dated Jan. 31, 2003, in the name of Toshiaki Hirano et al.
Patents Abstracts of Japan, Publication No. 2003-109511, dated Apr. 11, 2003, in the name of Kazuyuki Hasegawa et al.
Patent Abstracts of Japan, Publication No. 2004-134407, dated Apr. 30, 2004, in the name of Eung Chul Park et al.
Patent Abstracts of Japan Publication No. JP2000-063171 dated Feb. 29, 2000 in the name of Takenouchi et al.
Patent Abstracts of Japan Publication No. JP2001-035382 dated Feb. 9, 2000 in the name of Sakurai et al.
Patent Abstracts of Japan Publication No. 10-334809 dated Dec. 18, 1998 in the name of Nakahara et al.

* cited by examiner

PLASMA DISPLAY PANEL WITH MAGNESIUM OXIDE PROTECTION LAYER INCLUDING DOPANTS

CROSS-REFERENCE TO RELATED APPLICATION

This application claims priority to and the benefit of Korean Patent Application No. 10-2004-0037268 filed on May 25, 2004 in the Korean Intellectual Property Office, the entire content of which is incorporated herein by reference.

FIELD OF THE INVENTION

The present invention relates to a plasma display panel, and more particularly, to a plasma display panel comprising a protection layer comprising a sinter including dopant elements. The sinter has a faster response time than a single crystal and is less dependent on temperature than conventional sinters. The plasma display panel according to the present invention exhibits improved discharge stability.

BACKGROUND OF THE INVENTION

Typically, plasma display panels ("PDP"s) are display devices in which ultraviolet light excites phosphors in vacuum, thereby creating gas discharge in discharge cells. PDPs are the next generation thin-film display devices and can be manufactured with large high-resolution screens.

PDPs display letters or graphics using the light emitted from the plasma generated upon discharging the gas. That is, plasma is discharged to generate ultraviolet light upon application of voltage to two electrodes mounted within the discharge space of the plasma display panel. The ultraviolet light then excites the patterned phosphor layers to display a certain image.

Plasma display panels are generally classified into three types: an alternating current type (AC type), a direct current type (DC type) and a Hybrid type. FIG. 4 is a partial perspective view of a discharge cell of a conventional alternating current plasma display panel. As shown in FIG. 4, a conventional plasma display panel 100 comprises a first substrate 111, a plurality of address electrodes 115 formed on the first substrate 111, a dielectric layer 119 formed on the first substrate 111 over the address electrodes 115, a plurality of barrier ribs 123 formed on the dielectric layer 119 to maintain discharge distance and to prevent cross talk between cells, and phosphor layers 125 formed on the surface of the barrier ribs 123.

A plurality of discharge sustain electrodes 117 are formed on the second substrate 113, are positioned facing the first substrate 111, and are spaced apart from the address electrodes 115 on the first substrate 111. A dielectric layer 121 is positioned on the discharge sustain electrodes 117, and a protection layer 127 is positioned on the dielectric layer 127. The protection layer 127 mainly comprises MgO because MgO is transparent enough to transmit visible rays, effectively protects the dielectric layer and emits secondary electrons. Recently, it has been suggested to include additional materials in the protection layer.

The MgO protection layer is a transparent thin film having a sputtering-resistant characteristic. The protection layer absorbs the ion collisions produced by the discharge gas upon discharge during driving of the plasma display panel, thereby protecting the dielectric layer from the ion collisions and decreasing the discharge voltage by emitting secondary electrons. The protection layer is generally formed on the dielectric layer and generally ranges in thickness from 5000 Å to 9000 Å. The MgO protection layer may be formed by sputtering, electron beam deposition, ion beam assisted deposition (IBAD), chemical vapor deposition (CVD), sol-gel techniques and so on. Recently, ion plating has been developed and used to form a MgO protective layer.

Electron beam deposition provides a MgO protection layer by accelerating an electron beam with electric and magnetic fields and colliding that electron beam with the MgO deposition material. The deposition material is then heated and evaporated. Sputtering provides a denser protection layer with improved crystal alignment, but involves increased production costs. In sol-gel methods, the MgO protection layer is formed as a liquid.

Ion plating has recently been suggested as an alternative to form a variety of MgO protection layers. In this method, the evaporated particles are ionized and form a target. Ion plating has characteristics similar to those of sputtering, namely adhesion and crystallinity of the MgO protection layer, but can be carried out at high speeds, for example 8 nm/s.

Because the MgO protection layer contacts the discharge gas, discharge characteristics largely depend on the composition and characteristics of the protection layer. The characteristics of the MgO protection layer depend on the composition of the layer and the condition of the layer when formed. Therefore, a need exists for a MgO protective layer having a composition which improves the characteristics of the layer.

The protection layer mainly comprises MgO, and can be either a single crystal type or a sinter type. The sinter type protection layer has a faster response time than the single crystal material, but the response time is dependent on temperature and therefore changes with the environmental temperature. This temperature dependence substantially decreases discharge reliability and driving stability, and is therefore not suitable for mass production.

The single crystal protection layer has low temperature dependence, but slow response time, making it difficult to respond to the driving of a single scan and to produce a high definition PDP. These characteristics are confirmed by address discharge delay measurements taken at specific temperatures for PDP protection layers prepared by heat deposition of both a single crystal MgO material and a sinter material.

SUMMARY OF THE INVENTION

The present invention is directed to a plasma display panel capable of decreasing temperature dependence of the discharge characteristic and improving response time and discharge stability by doping either a single crystal MgO material or a MgO sinter material with a trace element.

The present invention is directed to a plasma display panel comprising a MgO protection layer including certain dopants. This plasma display panel (PDP) exhibits improved display quality and can control the inability of certain cells to discharge due to their inability to light.

In one embodiment, the present invention provides a plasma display panel comprising a first substrate and a second substrate positioned facing each other and separated from each other by a predetermined distance. The first and second substrates are disposed substantially parallel to each other. A plurality of address electrodes are positioned on the first substrate. A first dielectric layer is positioned over the plurality of address electrodes, which are positioned on surface of the first substrate facing the second substrate. A plurality of barrier ribs are positioned on the first dielectric layer and have predetermined heights to provide a discharge space between the first and second substrate. Phosphor layers are positioned within the discharge space. A plurality of discharge sustain electrodes are positioned on the surface of the second substrate facing the first substrate, and are positioned perpendicular to the address electrodes. A second dielectric layer is positioned on the second substrate covering the discharge sustain electrodes. A protection layer comprising MgO and Ca, Al, Fe and Si dopants is positioned over the second dielectric layer.

BRIEF DESCRIPTION OF THE DRAWINGS

The accompanying drawings, which are incorporated in and constitute a part of the specification, illustrate exemplary embodiments of the invention, and, together with the description, serve to better explain the principles of the invention.

DETAILED DESCRIPTION

Figure 1:
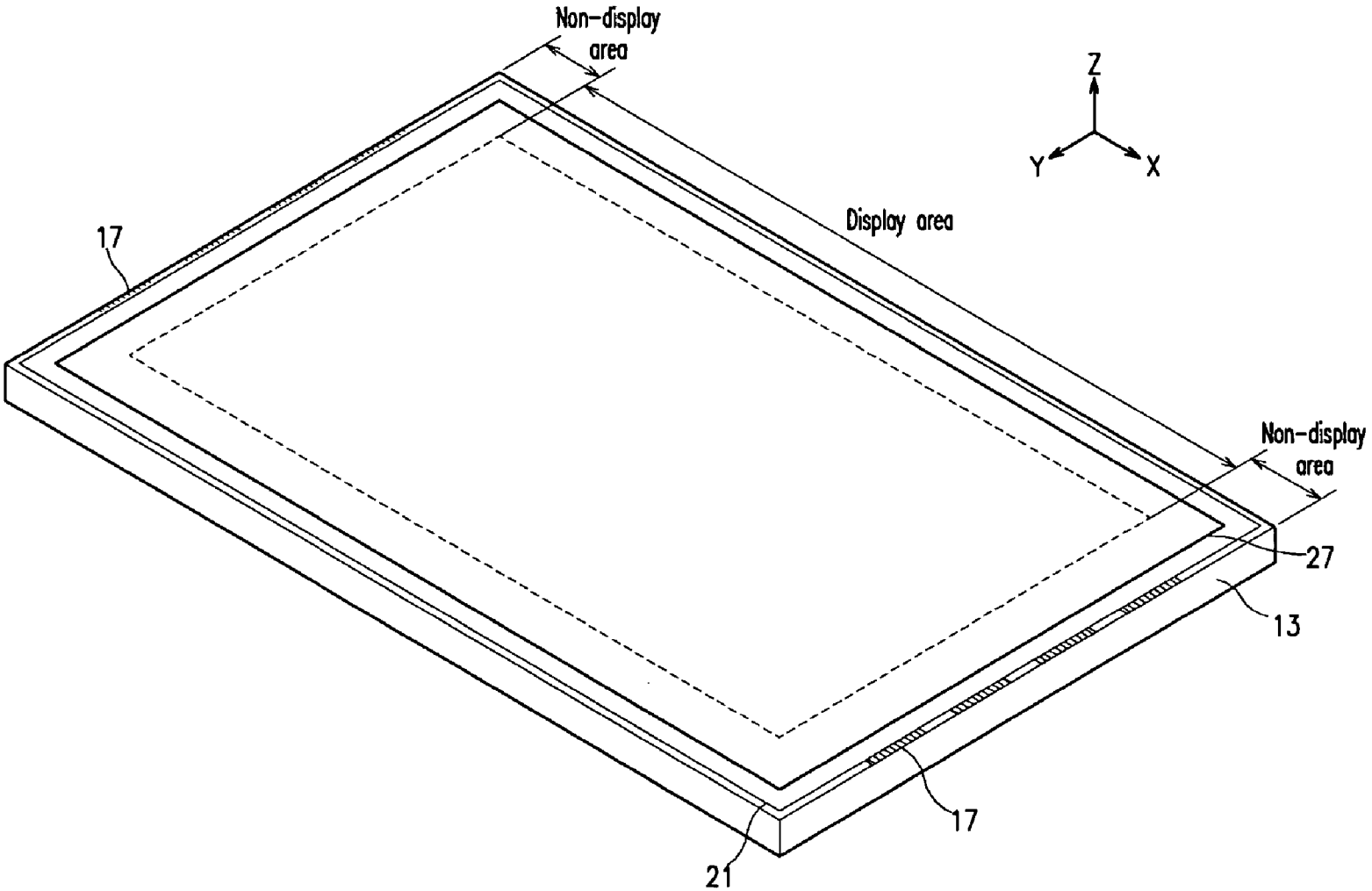
FIG. 1 is a perspective view of a second substrate of a plasma display panel according to one embodiment of the present invention.

In the following detailed description, exemplary embodiments of the invention are shown and described, including the best mode contemplated by the inventors of carrying out the invention. Those of ordinary skill in the art will realize that the invention can be modified in many respects without departing from the principle and scope of the invention. Accordingly, the drawings and description are illustrative only, and not restrictive.

The present invention relates to a plasma display panel ("PDP") having a MgO protection layer capable of improving display quality.

A MgO sinter is used for the PDP protection layer because it can be doped with certain elements in fixed quantities to improve discharge characteristics. By using the MgO sinter, the quantity of dopant elements can be freely determined within the solid solution limit.

It is difficult to add a fixed quantity of a certain dopant, such as Si, to a single crystal MgO material due to the difference in the solid solution limit determined by the cooling rate upon melting. However, according to one embodiment of the present invention, certain dopants can be added in fixed quantities to the MgO sinter material or raw material which is heat deposited to prepare a thin magnesium oxide (MgO) film. According to this embodiment, the address discharge delay when the PDP is discharged is minimized and the display quality is improved.

Trace elements can be used to dope a single crystal MgO material. Similar trace elements, in a fixed quantity, can also be used to dope a MgO sinter material. When used to dope a single crystal material, the dopants provide a single crystal material having low temperature dependence, thereby improving discharge stability and reliability.

The dopants include Ca, Al, Fe and Si. These dopants improve discharge stability due to their interaction with each other.

According to one embodiment of the present invention, the protection layer of the plasma display panel comprises MgO and a dopant comprising Ca, Al, Fe, and Si.

In one embodiment, Ca is present in the protection layer in an amount of about 100 to about 300 ppm based on the amount of MgO. Preferably, Ca is present in an amount of about 150 and about 250 ppm based on the amount of MgO. When Ca is present within this range, the discharge delay is shortened. However, when Ca is present in an amount less than about 100 ppm or greater than about 300 ppm, the discharge delay is unpreferably prolonged.

In one embodiment, Al is present in the protection layer in an amount of about 60 to about 90 ppm based on the amount of MgO. Preferably, Al is present in an amount of about 70 to about 80 ppm based on the amount of MgO. The discharge delay can be controlled by the amount of Al. If Al is present in an amount outside the above range, the discharge delay is not desirable.

In one embodiment, Fe is present in the protection layer in an amount of about 60 to about 90 ppm based on the amount of MgO. Preferably, Fe is present in an amount of about 70 to about 80 ppm based on the amount of MgO. The discharge delay depends on the amount of Fe. If Fe is present in an amount outside the above range, the discharge delay is not desirable.

In one embodiment, Si is present in an amount of about 40 to about 100 ppm based on the amount of MgO. Preferably, Si is present in an amount of about 50 to about 70 ppm. When Si is present in an amount within the above range, the discharge delay is shortened. When Si is present in an amount less than about 40 ppm or greater than about 100 ppm, the discharge delay is unpreferably prolonged.

Hereinafter, an exemplary embodiment of a plasma display panel comprising a protection layer according to one embodiment of the present invention will be described in detail with reference to the accompanying drawings.

FIG. 1 is a partial view of a second substrate of a plasma display panel comprising a protection layer according to one embodiment of the present invention. FIG. 1 shows the surface of the second substrate that faces the first substrate. As shown in FIG. 1, a plurality of discharge sustain electrodes 17 are positioned on the second substrate. A second dielectric layer 21 is positioned over the electrodes 17. A protection layer 27 comprising Ca, Al, Fe and Si dopants according to one embodiment of the present invention is positioned on the dielectric layer 21.

Figure 1A:
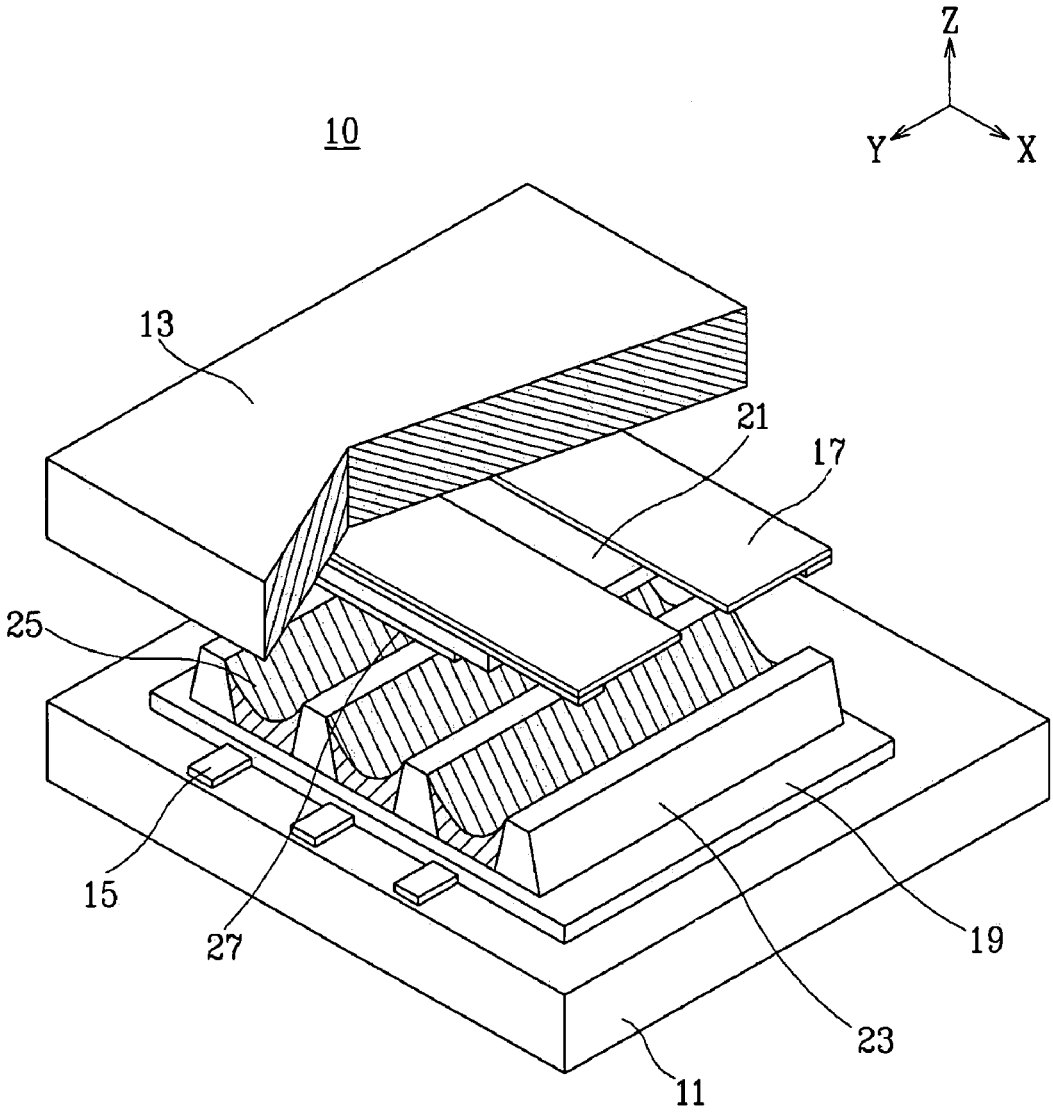
FIG. 1*a* is a partial perspective view of a plasma display panel according to one embodiment of the present invention.

FIG. 1*a* is a partial perspective view of a plasma display panel 10 including the second substrate of FIG. 1. As shown in FIG. 1*a* a plurality of address electrodes 15 are positioned on a first substrate 11 facing the second substrate 13. The address electrodes 15 are positioned perpendicular to the discharge sustain electrodes 17 on the second substrate. A first dielectric layer 19 covers the address electrodes 15. Barrier ribs 23 are positioned on the first dielectric layer 19. Phosphor layers 25 are coated between the barrier ribs 23, thereby forming the first substrate 11 of a plasma display panel.

Therefore, a plasma display panel according to one embodiment of the present invention comprises first and second substrates 11 and 13, respectively, positioned substantially parallel to each other, facing each other and separated from each other by a predetermined distance.

Address electrodes 15 are positioned on the surface of the first substrate 11 facing the second substrate 13, and are positioned substantially perpendicular to the discharge sustain electrodes 17 positioned on the surface of the second substrate 13 facing the first substrate 11. A first dielectric layer 19 covers the plurality of address electrodes 15. A plurality of barrier ribs 23 having predetermined heights are mounted on the first substrate 11 and extend into the space between the first and second substrates 11 and 13, respectively. The barrier ribs 23 are separated from each other by predetermined intervals, creating discharge spaces between the ribs. Phosphor layers 25 are positioned in the discharge spaces on the first dielectric layer 19 and on the sides of the barrier ribs 23.

A plurality of discharge sustain electrodes 17 are positioned on the surface of the second substrate 13 facing the first substrate 11. The discharge sustain electrodes 17 are positioned substantially perpendicular to the address electrodes 15 on the first substrate. A second dielectric layer 21 covers the discharge sustain electrodes 17. A MgO protection layer covers the second dielectric layer and comprises MgO and dopants including Ca, Al, Fe, and Si.

The edges of the first and second substrates of the resultant plasma display panel are coated with frit to seal the substrates. The construction is then injected with either Ne or Xe discharge gas to provide a plasma display panel.

In a plasma display panel according to one embodiment of the present invention, a driving voltage is applied to the address electrodes, thereby generating an address discharge between the address electrodes and forming a wall current in the first dielectric layer. After address discharge, current is alternatingly fed to the discharge sustain electrodes, thereby creating sustain discharge between the discharge sustain electrodes. Consequently, the discharge gas within the discharge spaces of the discharge cells is excited and shifted, thereby generating ultraviolet rays. These ultraviolet rays excite the phosphors, thereby generating visible rays, and displaying the desired images.

As shown in FIG. 1, pixels, i.e. areas where a plurality of electrodes intersect, are formed within the area covered by the protective layer. The pixels form a display area. Areas outside of the display area are non-display areas. The terminal parts of the discharge sustain electrodes 17 on the second substrate 13 are shown to the right and left of the protective layer 27 and contact a flexible printed circuit (FPC)(not shown).

The plasma display panels of the present invention may be fabricated according to any known method. Methods of fabricating plasma display panels are well known to those skilled in the art. However, the process for forming the MgO protection layer will be described below.

The protection layer covers the second dielectric layer of the plasma display panel to protect the dielectric layer from ion collisions of the discharge gas during discharge. As described above, the protection layer comprises MgO, is sputtering resistant and has high second electron emission properties. The MgO material of the protection layer may include a single crystal material or a sinter material. However, when the MgO material comprises a single crystal material, it is difficult to add a fixed quantity of a certain dopant due to the difference between solid solution limits because the cold rate is different upon melting than for deposition. When a MgO sinter material is used, or a raw material is prepared, the dopants, such as Ca, Al, Fe, and Si, are added in a fixed amount to provide a MgO protection layer by deposition of the plasma.

The protection layer may be formed by thick film printing of a paste. However, deposition is preferred because thick layer printing is less resistant to sputtering caused by ion collisions. Therefore, it is more difficult to decrease the discharge sustain voltage and the discharge initial voltage due to second electron emission.

Plasma deposition methods for forming the protection layer may include electron beam deposition, ion plating, magnetron sputtering and so on.

As described above, in one embodiment, Ca is present in the protection layer in an amount of about 100 to about 300 ppm, preferably in an amount of about 150 to about 250 ppm based on the amount of MgO. Al is present in an amount of about 60 to about 90 ppm, preferably in an amount of about 70 to about 80 ppm based on the amount of MgO. Fe is present in an amount of about 60 to about 90 ppm, preferably in an amount of about 70 to about 80 ppm based on the amount of MgO. Si is present in an amount of about 40 to about 100 ppm, preferably in an amount of about 50 to about 70 ppm based on the amount of MgO.

The MgO protection layer is formed by molding the deposition material into pellets and sintering the pellets. The size and shape of the pellets are preferably optimized because the decomposition rate of the pellets depends on the size and shape of the pellets, and because the size and shape of the pellets affects the deposition rate of the protection layer.

Further, the composition of the protection layer and the characteristics of the layer remarkably improve discharge characteristics because the MgO protection layer contacts the discharge gas. The characteristics of the MgO protection layer substantially depend on the composition of the layer and the conditions under which the layer is formed. Accordingly, optimal compositions suitable for improving the layer characteristics are preferably used.

The following examples illustrate the present invention in further detail. However, it is understood that the present invention is not limited by these examples.

EXAMPLE 1

Discharge sustain electrodes comprising indium tin oxide conductive materials were positioned on a second substrate in a striped pattern. The second substrate comprised soda lime glass.

Then, a lead-based glass paste was coated on the second substrate over the discharge sustain electrodes and sintered to form a second dielectric layer.

A protection layer comprising MgO powder and a dopant material comprising Ca, Al, Fe and Si was ion plated to the second dielectric layer, thereby forming a second substrate. Based on the amount of MgO, Ca was added in an amount of 150 ppm, Al was added in an amount of 70 ppm, Fe was added in an amount of 70 ppm, and Si was added in an amount of 50 ppm.

COMPARATIVE EXAMPLE 1

A second substrate was fabricated by the same procedure as in Example 1, except that the amount of Ca was 15 ppm, the amount of Al was 10 ppm, the amount of Fe was 10 ppm, and the amount of Si was 40 ppm based on the amount of MgO.

COMPARATIVE EXAMPLE 2

A second substrate was fabricated by the same procedure as in Example 1, except that the amount of Ca was 800 ppm, the amount of Al was 130 ppm, the amount of Fe was 30 ppm, and the amount of Si was 220 ppm based on MgO.

COMPARATIVE EXAMPLE 3

A second substrate was fabricated by the same procedure as in Example 1, except that the amount of Ca was 420 ppm, the amount of Al was 260 ppm, the amount of Fe was 77 ppm, and the amount of Si was 300 ppm based on MgO.

Testing Method

Figure 2:
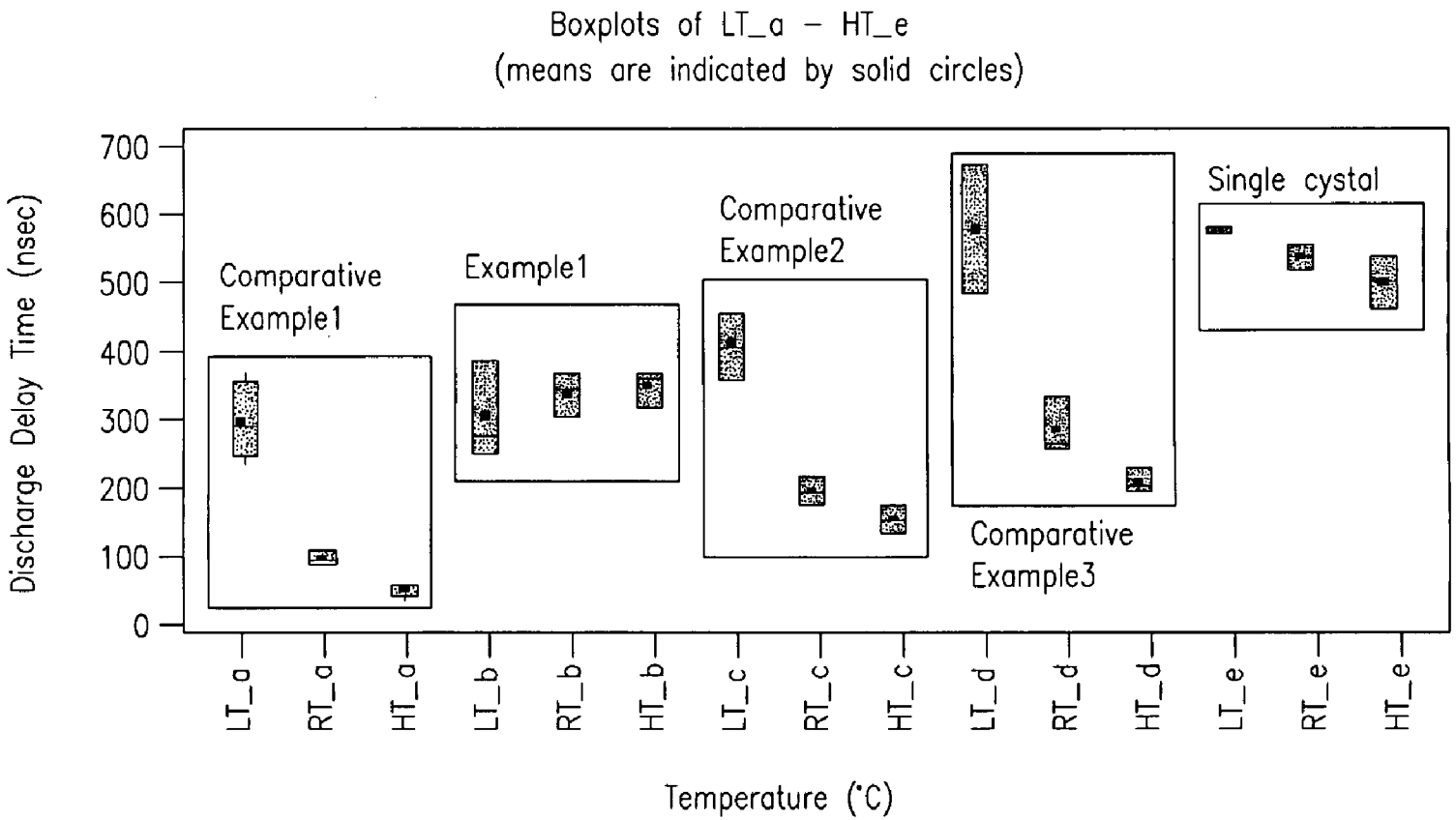
FIG. 2 is a graph comparing the response time relative to temperature of a MgO protection layer of a plasma display panel according to one embodiment of the present invention to that of a single crystal MgO protection layer according to the prior art.

The discharge sustain time (response time) relative to temperature of the protection layers fabricated according to Example 1 and Comparative Examples 1 to 3 were measured and the results are shown in FIG. 2, which compares these results to those of the single crystal material of the prior art. To determine how the dopants, i.e. Ca, Al, Fe, and Si, effect the sensitivity of MgO to the change in outside temperature, the response times of the resultant plasma display panels were measured at a low temperature (LT) of −10° C., at room temperature (RT) of 25° C. and at a high temperature (HT) of 70° C. As shown in FIG. 2, the protection layer according to Example 1 had a faster response time than the protection layers according to Comparative Examples 1 to 3. In addition, the protection layer according to Example 1, which contained appropriate amounts of Ca, Al, Fe and Si, had lower temperature dependence than the protection layers according to Comparative Examples 1 to 3. These results demonstrate that a protection layer according to the present invention exhibits deceased temperature dependence while improving discharge stability and reliability.

Experimental Example

Critical characteristics of MgO protection layers containing Ca, Al, Fe and Si dopants were measured. The second substrate and MgO protective layer were fabricated by the same method as in Example 1, except that the amounts of the dopant elements used are as shown in Table 1, below. Table 1 and FIG. 3 compare the response times relative to dopant amounts achieved by the protection layers.

TABLE 1

| | | | | | | | | | | | | |
|---|---|---|---|---|---|---|---|---|---|---|---|---|
| Ca | Content (ppm) | 20 | 60 | 80 | 90 | 100 | 120 | 150 | 200 | 250 | 300 | 320 |
| | Response time (nsec) | 683 | 487 | 433 | 352 | 238 | 187 | 152 | 149 | 158 | 226 | 347 |
| Al | Content (ppm) | 20 | 40 | 50 | 60 | 70 | 80 | 90 | 100 | 110 | 120 | 130 |
| | Response time (nsec) | 552 | 481 | 415 | 294 | 265 | 251 | 294 | 395 | 432 | 419 | 435 |
| Fe | Content (ppm) | 50 | 60 | 70 | 80 | 90 | 100 | 110 | 120 | 130 | — | — |
| | Response time (nsec) | 359 | 283 | 235 | 249 | 271 | 334 | 387 | 395 | 411 | — | — |
| Si | Content (ppm) | 20 | 40 | 50 | 60 | 70 | 80 | 100 | 120 | 150 | 170 | 200 |
| | Response time (nsec) | 253 | 182 | 153 | 142 | 159 | 162 | 151 | 188 | 197 | 253 | 249 |

Figure 3:
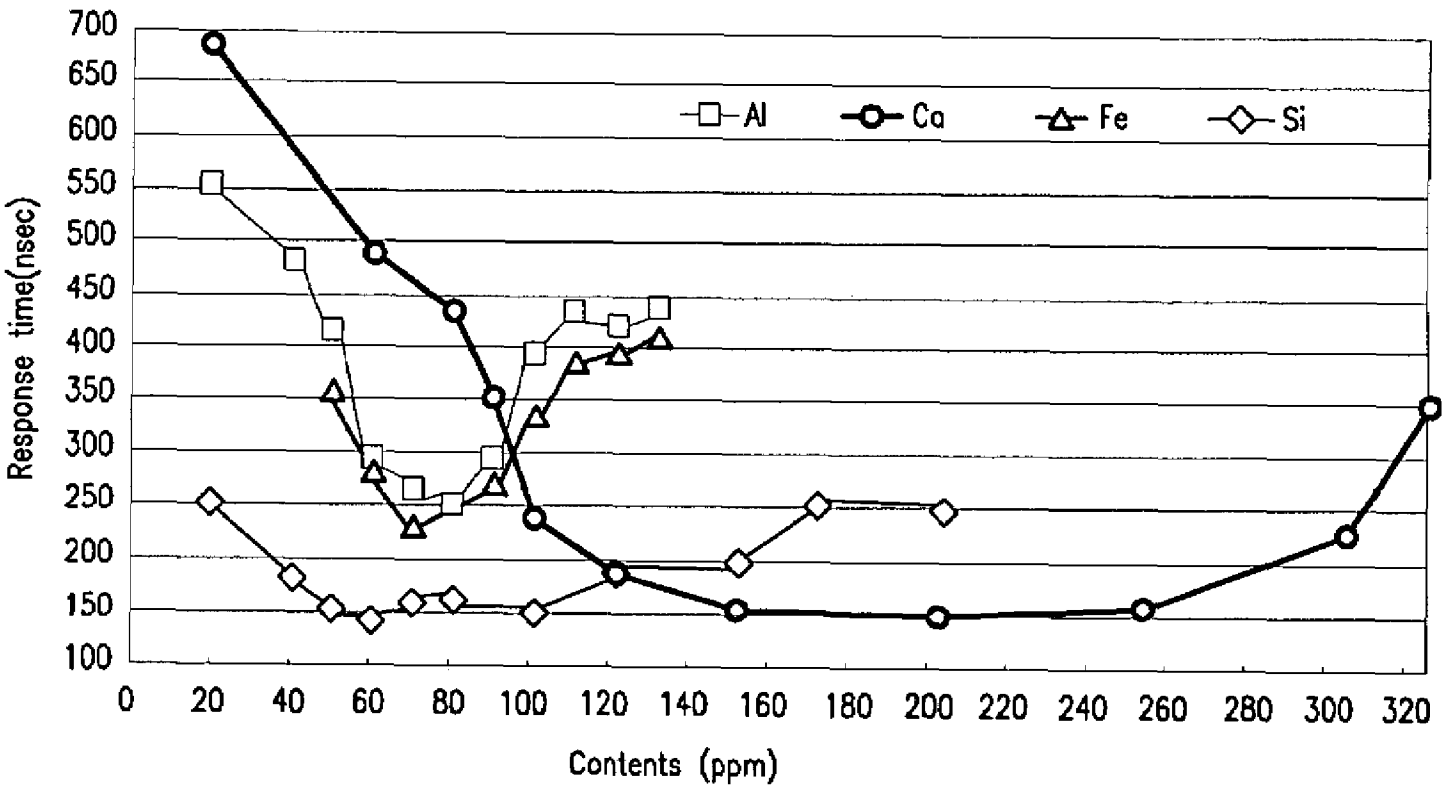
FIG. 3 is a graph comparing the response times relative to composition of various MgO protection layers according to the present invention.
Figure 4:
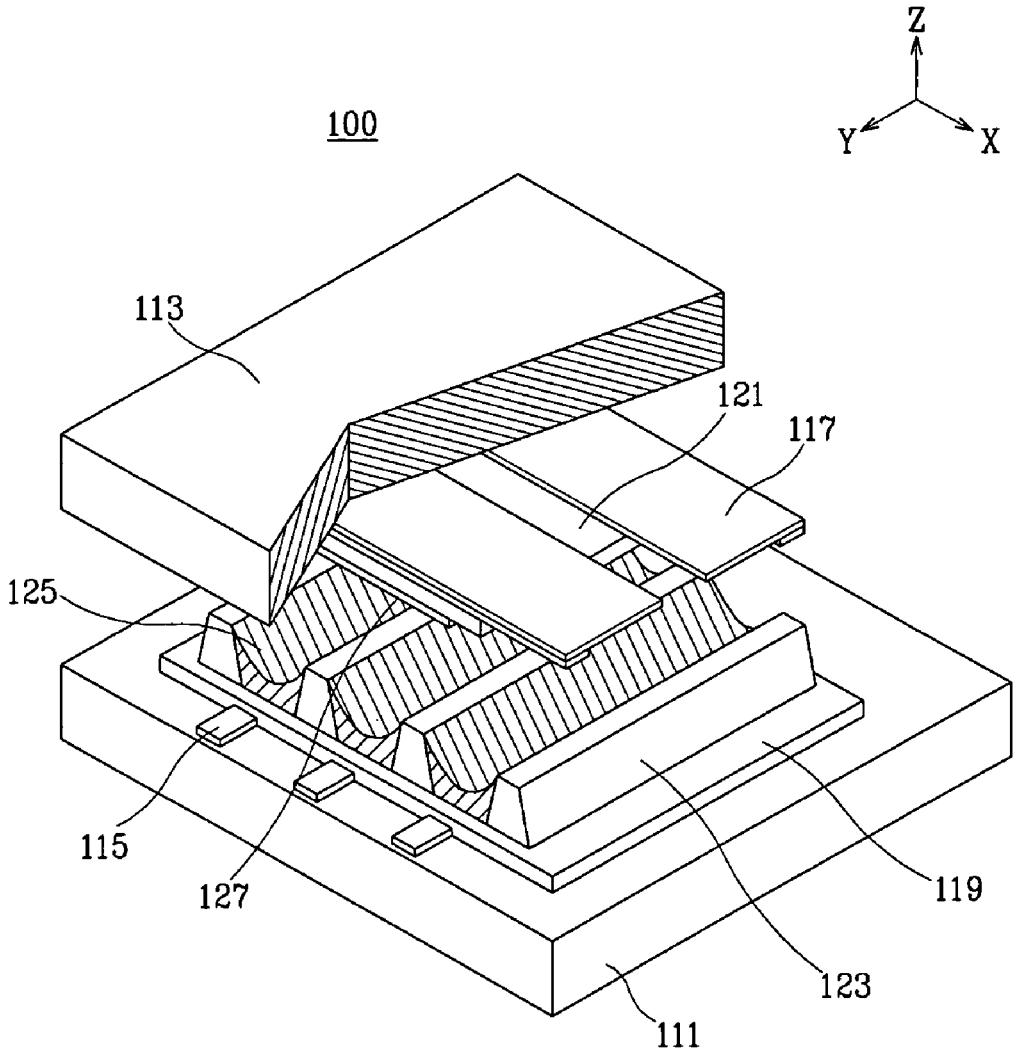
FIG. 4 (Prior Art)
FIG. 4 is a partial perspective view of an alternating current type plasma display panel according to the prior art.

As shown in Table 1 and FIG. 3, the shortest response times correspond to doping contents of the MgO protective layer that are within the ranges discussed above. Specifically, the shortest response times occurred when Ca was present in an amount of 100-300 ppm, Al was present in an amount of 60-90 ppm, Fe was present in an amount of 60-90 ppm, and Si was present in an amount of 40-100 ppm. Although the amount of a single dopant is significant, the interaction of the dopants plays an important role in decreasing temperature dependence and response time.

As described above, a plasma display panel according to one embodiment of the present invention comprises a protection layer mainly comprising a MgO sinter material and a dopant comprising Ca, Al, Fe, and Si. The interaction of the dopants minimizes the address discharge delay time upon plasma discharging, thereby improving discharge stability and display quality.

While the present invention has been described in detail with reference to exemplary embodiments, those skilled in the art will appreciate that various modifications and substitutions can be made thereto without departing from the spirit and scope of the present invention as set forth in the appended claims.

What is claimed is:

1. A plasma display panel comprising:

first and second substrates positioned facing each other and separated from each other by a predetermined distance;

a plurality of address electrodes positioned on the first substrate;

a first dielectric layer covering the plurality of address electrodes;

a plurality of barrier ribs mounted on the first dielectric layer, providing discharge spaces between the first and second substrates;

a plurality of phosphor layers formed in the discharge spaces;

a plurality of discharge sustain electrodes positioned on the second substrate;

a second dielectric layer covering the discharge sustain electrodes; and a protection layer covering the second dielectric layer, the protection layer comprising MgO and a dopant comprising Ca, Al, Fe, and Si, wherein Ca is present in an amount of about 100 to about 300 ppm based on the amount of MgO, Al is present in an amount of about 60 to about 90 ppm based on the amount of MgO, Fe is present in an amount of about 60 to about 90 ppm based on the amount of MgO, and Si is present in an amount of about 40 to about 100 ppm based on the amount of MgO.

2. The plasma display panel according to claim 1, wherein Ca is present in the protection layer in an amount of about 150 to about 250 ppm based on the amount of MgO.

3. The plasma display panel according to claim 1, wherein Al is present in the protection layer in an amount of about 70 to about 80 ppm based on the amount of MgO.

4. The plasma display panel according to claim 1, wherein Fe is present in the protection layer in an amount of about 70 to about 80 ppm based on the amount of MgO.

5. The plasma display panel according to claim 1, wherein Si is present in the protection layer in an amount of about 50 to about 70 ppm based on the amount of MgO.

6. The plasma display panel according to claim 1, wherein the MgO comprises a single crystal material.

7. The plasma display panel according to claim 1, wherein the MgO comprises a sinter material.

8. A plasma display panel comprising:

first and second substrates positioned facing each other and separated from each other by a predetermined distance;

a plurality of address electrodes positioned on the first substrate;

a first dielectric layer covering the plurality of address electrodes;

a plurality of barrier ribs mounted on the first dielectric layer, providing discharge spaces between the first and second substrates;

a plurality of phosphor layers formed in the discharge spaces;

a plurality of discharge sustain electrodes positioned on the second substrate;

a second dielectric layer covering the discharge sustain electrodes; and a protection layer covering the second dielectric layer, the protection layer comprising MgO and a dopant comprising Ca, Al, Fe, and Si, wherein Ca is present in an amount of about 150 to about 250 ppm based on the amount of MgO, Al is present in an amount of about 70 to about 80 ppm based on the amount of MgO, Fe is present in an amount of about 70 to about 80 ppm based on the amount of MgO, and Si is present in an amount of about 50 to about 70 ppm based on the amount of MgO.

9. The plasma display panel according to claim 8, wherein the MgO comprises a single crystal material.

10. The plasma display panel according to claim 8, wherein the MgO comprises a sinter material.

* * * * *